United States Patent [19]

Kifferstein et al.

[11] 4,117,626

[45] Oct. 3, 1978

[54] SOUND-EMITTING TOY FLYING SAUCER

[76] Inventors: Harry P. Kifferstein, 27250 Harvard, Southfield, Mich. 48076; Warren M. Kifferstein, 29632 Middlebelt, Farmington Hills, Mich. 48024

[21] Appl. No.: 739,653

[22] Filed: Nov. 8, 1976

Related U.S. Application Data

[63] Continuation-in-part of Ser. No. 653,786, Jan. 30, 1976, abandoned.

[51] Int. Cl.[2] ..... A63H 33/18

[52] U.S. Cl. ..... 46/74 D

[58] Field of Search ..... 46/74 D; 273/106 B

[56] References Cited

U.S. PATENT DOCUMENTS

| | | | |
|---|---|---|---|
| 3,758,985 | 9/1973 | Heisler | 46/74 D |
| 3,959,916 | 6/1976 | Meyer | 46/74 D |
| 3,959,917 | 6/1976 | Dawson | 46/74 D |

FOREIGN PATENT DOCUMENTS

| | | | |
|---|---|---|---|
| 1,603,662 | 5/1971 | France | 46/74 D |

*Primary Examiner*—Louis G. Mancene
*Assistant Examiner*—Robert F. Cutting
*Attorney, Agent, or Firm*—Hauke and Patalidis

[57] ABSTRACT

A toy flying saucer having a double skinned body, substantially circular and dome-shaped, and defining lower and upper wall portions joined proximate the rim of the dome-shaped body. An embodiment of the invention contemplates that the upper and lower walls are normally urged in close proximity and may be manually separated so as to form a variable volume air chamber therebetween. An orifice is disposed at least in the lower wall, with a noise-emitting element, such as a whistle or a siren, inserted in the orifice. Prior to launching, the upper and lower walls are manually separated so as to fill the chamber therebetween with air, and air is allowed to escape during flight through the orifice provided with the noise-emitting element.

Another embodiment of the invention consists in having the upper and lower walls normally separated such as to form an air chamber therebetween which can be manually collapsed prior to launching the toy flying saucer. A noise-emitting element is inserted in an orifice disposed in one of the walls and, during flight, air is allowed to enter into the chamber due to the upper and lower walls being normally urged away from each other, thus causing air to circulate through the noise-emitting element.

11 Claims, 11 Drawing Figures

FIG. 1
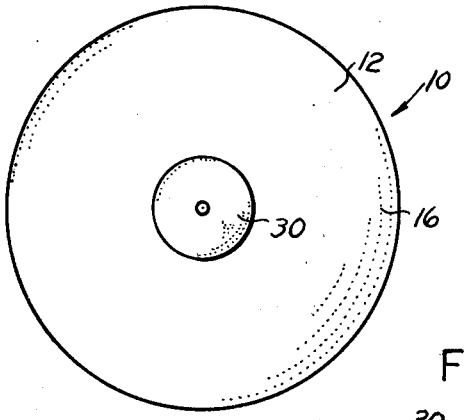
FIG. 2
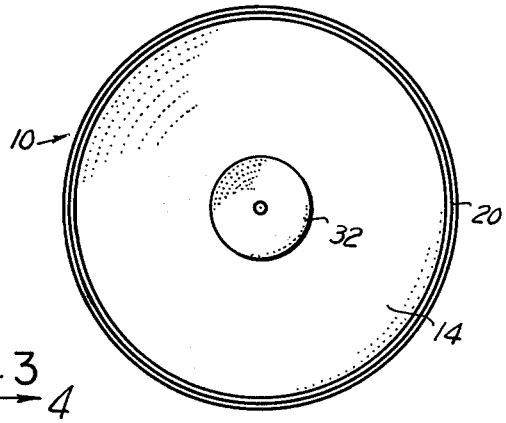
FIG. 3
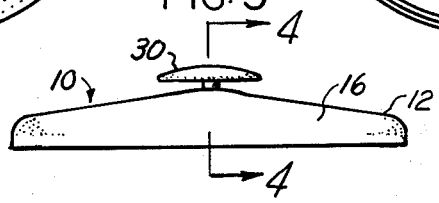
FIG. 4
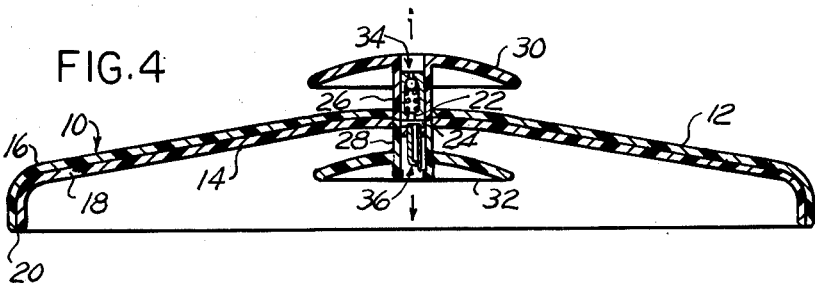
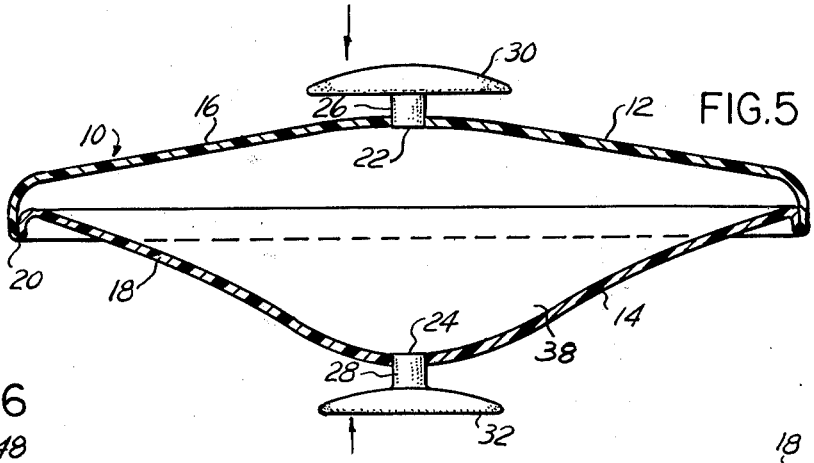
FIG. 5
FIG. 6
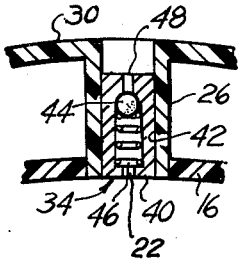
FIG. 7
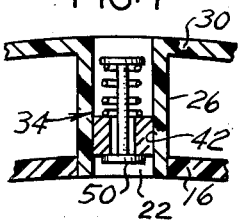
FIG. 8
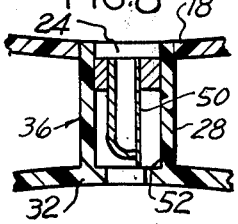
FIG. 9
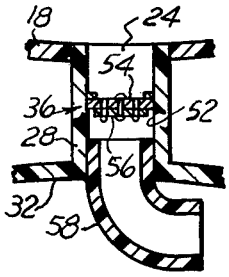

FIG. 10
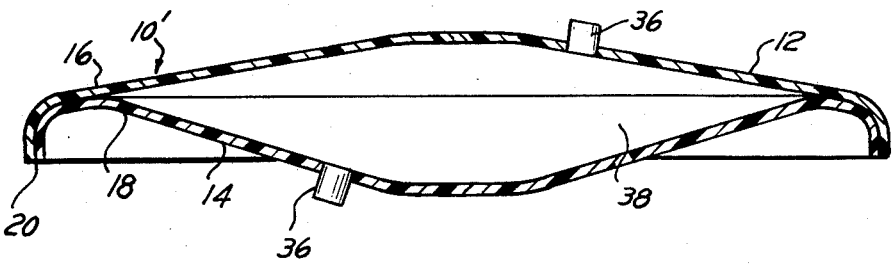
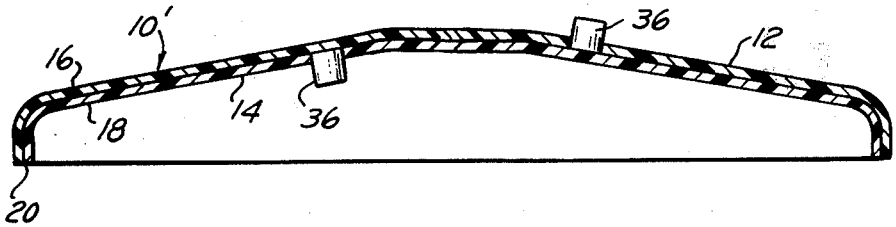
FIG. 11

SOUND-EMITTING TOY FLYING SAUCER

CROSS-REFERENCE TO RELATED APPLICATIONS

This application is a continuation-in-part of application Ser. No. 653,786, filed Jan. 30, 1976 now abandoned.

BACKGROUND OF THE INVENTION

The present invention relates to improvements to saucer-shaped flyable toys which can be manually thrown and caused to sail through the air with a spinning motion. Typically, such saucer-shaped flyable toys have a curved convex upper surface and a corresponding curved concave lower surface, the surfaces ending in a turned down rim which is manually grasped for tossing the toy in the air with a spinning motion.

Conventional toy flying saucers are generally capable of soaring silently through the air. It is readily apparent that if such toys were capable of emitting a sound while being sailed through the air and spinning, additional enjoyment would result from such characteristics of the toy.

Attempts have been made in the past to provide toy flying saucers with noise-making devices, as disclosed for example in U.S. Pat. Nos. 3,900,986 and 3,900,987, by providing the outer periphery or rim of the toy with whisltes. However, the inconveniences of such whistles mounted on the rim of the toy are many. The whistles may interfere with the flight characteristics of the toy flying saucer, they substantially increase the drag and do not operate if the toy is spun too slowly or in a direction opposite to that normally operating the whistles. In addition, if some of the whistles are reversed for providing a sound effect irrespective of the direction of rotation of the toy, silent flights are not available at will, as spinning of the flying saucer is a prerequisite to obtaining a correct flight trajectory.

SUMMARY OF THE INVENTION

The present invention is an improved toy flying saucer having superior flight characteristics and having the additional feature of emitting a sound at the will of the user, such sound-emitting quality being independent from and not interfering with the flight characteristics of the toy. The objects and advantages of the present invention are achieved by modifying the structure of conventional amusement devices known as toy flying saucers by providing a double-skinned dome-shaped body with manual means for forming between a dome-shaped upper wall and a dome-shaped lower wall a variable volume air chamber, with appropriate apertures permitting either the introduction or expulsion of air between the walls of the chamber manually prior to launching, and by placing in the flow of air from or into the chamber a noise-emitting device operable in flight when the two wall portions of the body are caused to be resiliently displaced towards each other, or alternatively away from each other, thus decreasing the volume of the air chamber and expelling the air contained therein, or increasing the volume of the chamber and introducing air therein.

The diverse objects and advantages of the present invention will become apparent to those skilled in the art when the following description of the best mode contemplated for practicing the invention is read in conjunction with the accompanying drawing wherein like reference numerals relate to like or equivalent elements and in which:

BRIEF DESCRIPTION OF THE DRAWING

FIG. 1 is a top plan view of a noise-making toy flying saucer according to the invention;

FIG. 2 is a bottom plan view thereof;

FIG. 3 is a side elevation view thereof;

FIG. 4 is a section along line 4—4 of FIG. 3, at an enlarged scale;

FIG. 5 is a view similar to FIG. 4 but showing the air chamber filled with air;

FIG. 6 is a detailed view of a portion thereof showing an example of check valve provided for introducing air into the air chamber thereof;

FIG. 7 is a view similar to FIG. 6 but showing a modified check valve;

FIG. 8 is a detailed veiw of an example of noise-emitting element according to the present invention;

FIG. 9 is a modification of the arrangement of FIG. 8; and

FIGS. 10 and 11 are views similar to FIGS. 4 and 5, but showing a modification of the present invention.

DETAILED DESCRIPTION OF THE PREFERRED EMBODIMENTS

Referring now to the drawing and more particularly to FIGS. 1–4 thereof, a toy flying saucer according to the present invention has a generally circular body 10, dome-shaped such as to define an upper convex surface 12 and a lower concave surface 14. As best shown at FIGS. 4 and 5, the body 10 is double-skinned, that is, provided with an upper wall body portion 16 and a lower wall body portion 18 each dome-shaped and both joined at or proximate their respective edges such as to form a downwardly oriented rim 20. Both the upper and lower dome-shaped wall portions 16 and 18 are preferably molded of a light plyable plastic material, such material being conventionally and conveniently used in prior art toy flying saucers. The two wall portions 16 and 18 are united at the rim 20, or proximate thereto, by any convenient means such as by cementing, by heat or supersonic welding, or by dimensioning the lower wall portion 18 with a larger outer diameter than the inner diameter of the upper wall portion 16 such that the lower wall portion 18 is elastically joined to the upper wall portion at, or proximate to, the rim 20. The latter construction, although providing a good seal at the surfaces in engagement, permits to separate at will the two wall portions and to fly each separately as an individual toy flying saucer.

Substantially at the center of the upper wall portion 16 there is disposed an aperture or orifice 22, and an orifice or aperture 24 is similarly disposed substantially at the center of the lower wall portion 18. A tubular member 26 is fastened over or within the upper aperture 22 and a second tubular member 28 is similarly fastened over or within the lower aperture 24, the tubular members 26 and 28 outwardly projecting respectively from the upper surface 12 and from the lower surface 14 of the body 10. The projecting end of the tubular member 26 has a manually graspable knob 30 fastened thereon or integrally molded therewith, and the end of the tubular member 28 is similarly provided with a knob 32. Preferably, the knobs 30 and 32 are slightly dished or dome-shaped such as to be aerodynamically compatible with the convex upper surface 12 and the concave lower surface 14 of the body 10 and to create a slot effect therewith which increases the lift characteristics of the body 10 when in flight. For that purpose, the knobs 30 and 32 are downwardly concave relative to the normal flight attitude of the body 10 after launch.

A one-way check valve 34 is disposed in the bore of the tubular member 26, and a noise-emitting element 36 is disposed in the bore of the tubular member 28, as described hereinafter in further detail. In this manner, by manually grasping the knob 30 in one hand and the knob 32 in the other hand, the user of the toy flying saucer is able to pull apart the knobs, thus moving apart the upper and lower wall portions 16 and 18, as illustrated at FIG. 5 in a somewhat exagerated manner, such that an air chamber 38 is formed between the upper and lower wall portions filled with air introduced through the check valve 34, and also through the element 36 as most air actuated noise-emitting devices allow reverse flow of air therethrough. The amount of manual deflection of the upper and lower walls 16 and 18 determines the capacity of the air chamber 38, up to a maximum permissible amount depending on the configuration and size of the body 10. In the example of structure illustrated, the lower wall portion 18 is shown as being less rigid than the upper wall portion 16 such that when the knobs 30 and 32 are pulled apart, the upper surface 12 of the body 10 maintains substantially the same configuration as illustrated at FIG. 4, while the lower surface 18 takes a substantially concave conical surface appearance. It has been found that a lower surface having such a configuration may actually improve the flight characteristics of the toy flying saucer. If so desired, the lower wall section 18 may be made of substantially rigid material while the upper secton 16 may be made of relatively flexible resilient deformable material, in order to maintain substantially constant the shape of the body lower surface 14. It will also be readily apparent that the upper and lower wall portions 16 and 18 may be made of such material and with such thickness such as to permit any degree of respective deflection as desirable. Because the body 10 is made of relatively flexible resilient plastic material, after launch and while spinning in flight in the air, the noraml resiliency of the material tends to automatically bias the two wall portions in close proximity to their original position illustrated at FIG. 4, such that the air contained in the air chamber 38 is caused to be expelled through the noise-emitting element 36, thus adding a sound impression to the visual flight of the toy flying saucer. If desired, additional biasing means may be disposed between the upper and lower portions 16 and 18, such as rubber bands or springs, not shown, for the purpose of aiding in urging the two wall portions 16 and 18 towards each other.

Any appropriate check valve 34 may be used, such as the well known ball check valve illustrated at FIG. 6 consisting of an apertured fitting 40 disposed in the bore 42 of the tubular member 26 provided with a ball 44 normally urged against its seat by a spring 46, thus interrupting the flow of air through the orifices 48 from the interior of the wall 16, while the flow of air in an opposite direction displaces the ball 44 from its seat against the action of the spring 46. The one-way check valve 34 may take the form illustrated at FIG. 7 consisting of a spring biased poppet valve 50. Other check valves may also be used such as reed valves and the like.

As illustrated at FIG. 8, the sound producing element 36 may take the form of a vibrating reed device 50 placed in the bore 52 of the tubular member 28. The air outlet in the illustration of FIG. 8 has been shown as being straight through, such that the air expelled from the chamber 28 is normally expelled vertically substantially at the center of the convex surface 14 (FIGS. 4 and 5), thus improving the lift and flying capabilities of the toy flying saucer. FIG. 9 illustrates another well known example of air-actuated noise emitting element in the form of an air siren consisting of a disk 54 held stationary within the bore 52 of the tubular element 28 having rotatably mounted thereon a vented disk 56, both the stationary disk and the vaned disk 56 having appropriately alignable apertures such that the air passing through the apertures of the stationary disk 54 causes the vaned disk 56 to rotate and modulate the air flow.

In the example of FIG. 9, the air outlet is by means of a bent-over nozzle 58 arranged to cause the air flow to be directed at an angle relative to the axis of rotation of the flying saucer body 10 while spinning in the air. In this manner, the stream of air ejected from the chamber 38 through the nozzle 58 is caused to accelerate and decelerate in the course of each revolution of the body 10, thus causing an additional modulation of the sound emitted by the noise maker element 36 and influencing somewhat the flying characteristics of the flying saucer body 10, creating a certain amount of wobbling and other attractive maneuvers.

With most noise-making elements such as vibrating reeds or air siren devices, it is not absolutely necessary to provide a one-way check valve 34 for introducing air into the variable volume chamber 38, as such noise-making elements permit flow of air therethrough in both directions. Eliminating the one-way check valve 34 and the air orifice or aperture 22 in the upper wall portion 16 simplifies the structure and reduces the manufacturing costs.

If so desired, the sound-emitting element 36 may be disposed in the tubular member 26 affixed to the upper wall portion 16. However, such an arrangement will tend to act as an aerodynamic spoiler rather than a lift improving element, as is the case when the air outlet is disposed to cooperate with the lower surface 14 of the body 10.

It will be appreciated that the noise-emitting element 36 may be disposed in an orifice or aperture formed through the lower wall section 18, or through the upper wall section 16. Alternatively a pair, or more, of such noise-emitting elements 36 may be disposed through appropriate apertures formed in each of the wall sections 16 and 18. Such a structure of toy flying saucer 10' is illustrated at FIGS. 10–11. Also, one of the tubular elements 26 or 28 may be plugged and the other provided with a one-way valve as the one-way valve 34 shown at FIG. 6 or 7. In arrangements where it is prefered not to use any one-way valve, both members 26 and 28 may be plugged or be made of a rod of plastic material.

The structure illustrated at FIGS. 10–11 has one such noise-emitting element 36 disposed through an aperture formed in the lower wall section 18 and one noise-emitting element 36 disposed substantially symmetrically in an aperture formed in the upper wall section 16. In addition, the embodiment of the invention illustrated at FIGS. 10–11 is made such that the lower wall portion 18 is normally in the position shown at FIG. 10, i.e., away from the upper wall section 16, thus forming therebetween the air chamber 38. Prior to launching, the lower wall section 18 is resiliently manually pushed against the upper wall section 16, as shown at FIG. 11, and after launch, the lower wall section 18 is allowed to slowly spring back to the position shown at FIG. 10, thus causing the air chamber 38 to fill with air admitted through the noise emitting elements 36. With such an arrangement as represented at FIGS. 10–11, the knobs 30 and 32 of the embodiment of FIGS. 1–5 which are not necessary have been omitted. One of the noise-making elements 36, preferably the upper one, may be a dummy plug, or other means for counter-balancing the weight of the active noise-emitting element 36 are disposed in the upper or lower wall section 16 or 14. It is preferable to have the active noise-emitting element 36 disposed in the lower wall portion 14 relatively close to the rim 20 such that one finger of the hand holding the toy saucer 10 can be conveniently used to obturate the noise-emitting element 36, after the air chamber 38 has been collapsed, to prevent introduction of air into the chamber prior to launching. It is readily apparent that the air flow being inverted through the noise-emitting element 36 of FIGS. 10–11, as compared to the arrangement of FIGS. 4–5, the noise-emitting element 36 is oriented such as to be activated to its noise-making mode when the flow of air therethrough is from the ambient to the collapsible chamber 38.

Although the body 10 or 10' of the toy flying saucer has been shown as having a substantially regular smooth upper and lower surface, it will be readily apparent that the present invention is adaptable to any flying saucer configuration, including those having stepped or irregular surfaces.

Having thus described the invention by way of typical practical examples thereof, modifications whereof will be apparent to those skilled in the art, what is claimed as new is as follows:

1. In a toy flying saucer comprising a substantially circular dome-shaped body and a downwardly extending rim formed at the periphery of said body, the improvement comprising said body made of lower and upper separable wall portions joined proximate said rim, wherein at least one of said wall portions is made of a resiliently deformable material, an aperture is provided in one of said wall portions, and an air flow actuated noise-making element is disposed in said aperture for emitting a sound when said wall portions are allowed to be resiliently displaced relative to each other thus causing air to circulate through said noise-making element.

2. The improvement of claim 1 wherein said aperture is disposed in the lower wall portion.

3. The improvement of claim 1 wherein said aperture is disposed in the upper wall portion.

4. The improvement of claim 1 wherein said upper and lower wall portions are normally urged in close proximity with each other and further comprising means for manually separating said lower and upper wall portions for forming therebetween a space filled with air introduced through said aperture.

5. The improvement of claim 4 further comprising an additional aperture in one of said wall portions, and a check valve in said last mentioned aperture for allowing air to enter said space between said wall portions when manually separated and for preventing reverse air flow when said wall portions are allowed to spring back in close proximity.

6. The improvement of claim 4 wherein said manually separating means comprises a pair of opposed knob-like appendages each fastened substantially at the center of one of said wall portions.

7. The improvement of claim 6 wherein said knob-like appendages are dome-shaped and have a downwardly directed concavity.

8. The improvement of claim 4 wherein said noise-making element has an air outlet axed substantially about the axis of symmetry of said dome-shaped body.

9. The improvement of claim 5 wherein said noise-making element has an air outlet axed at an angle to the axis of symmetry of said dome-shaped body.

10. The improvement of claim 2 wherein said upper and lower wall portions are normally urged away from each other such as to form an air chamber therebetween, and said noise-making element is arranged to emit noise when air flows from the ambient into said air chamber.

11. The improvement of claim 10 further comprising an additional aperture in one of said wall portions and a check valve in said last mentioned aperture for allowing air to escape from said air chamber between said wall portions and for preventing reverse air flow when said wall portions are allowed to spring back away from each other.

* * * * *

UNITED STATES PATENT AND TRADEMARK OFFICE

CERTIFICATE OF CORRECTION

PATENT NO. : 4,117,626

DATED : October 3, 1978

INVENTOR(S) : Harry P. Kifferstein et al

It is certified that error appears in the above-identified patent and that said Letters Patent are hereby corrected as shown below:

Column 1, line 29, delete "whisltes" and insert thereinstead --whistles--.

Column 3, line 33, delete "secton" and insert thereinstead --section--.

Column 3, line 42, delete "noraml" and insert thereinstead --normal--.

Column 4, line 9, delete "vented" and insert thereinstead --vaned--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*